US008454065B2

(12) United States Patent
Wolford

(10) Patent No.: US 8,454,065 B2
(45) Date of Patent: Jun. 4, 2013

(54) LIFTING TOOL FOR CONSTRUCTION OF MODULAR BLOCK STRUCTURES

(75) Inventor: Ronald J. Wolford, Pittsburgh, PA (US)

(73) Assignee: Ronald J. Wolford, Pittsburgh, PA (US)

( * ) Notice: Subject to any disclaimer, the term of this patent is extended or adjusted under 35 U.S.C. 154(b) by 338 days.

(21) Appl. No.: 12/796,827

(22) Filed: Jun. 9, 2010

(65) Prior Publication Data

US 2010/0308610 A1 Dec. 9, 2010

Related U.S. Application Data

(60) Provisional application No. 61/185,362, filed on Jun. 9, 2009.

(51) Int. Cl.
*B66C 1/66* (2006.01)

(52) U.S. Cl.
USPC ..... 294/63.1; 294/89; 294/81.5

(58) Field of Classification Search
USPC ..... 294/62, 63.1, 81.5, 81.56, 87.1, 89, 294/110.1, 112, 118
See application file for complete search history.

(56) References Cited

U.S. PATENT DOCUMENTS

| | | | | | |
|---|---|---|---|---|---|
| 897,040 | A * | 8/1908 | Wash | 294/81.1 |
| 2,384,396 | A * | 9/1945 | Peyer | 294/110.1 |
| 4,055,364 | A * | 10/1977 | Breite | 294/16 |
| 4,316,696 | A * | 2/1982 | Hoyerman | 414/542 |
| 4,355,833 | A * | 10/1982 | Dunbar | 294/81.51 |
| 4,474,400 | A | 10/1984 | Toffolon | |
| 4,969,789 | A * | 11/1990 | Searle | 414/10 |
| 5,490,702 | A | 2/1996 | Fleming | |
| 5,704,675 | A | 1/1998 | Reiley | |
| 6,481,769 | B1 | 11/2002 | Harris et al. | |
| 6,513,847 | B2 | 2/2003 | Harris et al. | |
| 6,736,586 | B2 | 5/2004 | Harris et al. | |
| 6,820,907 | B1 * | 11/2004 | Haynes | 294/63.1 |

* cited by examiner

*Primary Examiner* — Dean Kramer
(74) *Attorney, Agent, or Firm* — Fox Rothschild LLP

(57) ABSTRACT

A support structure for lifting precast blocks includes a longitudinal support arm having a cable suspended therefrom at a multiple suspension points. Several cradles are connected to the cable in positions such that each cradle is positioned between and below a pair of the suspension points. Each cradle may be attached to a sheave that movably connects it to the cable. Each cradle may receive a portion, such as a handle, of a lifting tool below the support arm.

13 Claims, 6 Drawing Sheets

LIFTING TOOL FOR CONSTRUCTION OF MODULAR BLOCK STRUCTURES

CROSS-REFERENCE TO RELATED APPLICATIONS

This patent application claims priority to U.S. provisional patent application No. 61/185,362, filed Jun. 9, 2009, entitled "Lifting Tool for Modular Block Structures."

BACKGROUND

This document describes a tool for use in the construction of modular block structures, such as retaining walls. In particular, this document describes a lifting tool that is useful for lifting blocks during the construction of modular block structures such as retaining walls.

Segmental retaining walls are structures made of modular, stacked, pre-cast blocks that provide a stable mass with sufficient weight to retain the pressure created by adjacent soil. In general, mortar is not used to secure the blocks in a segmental retaining wall system. Rather, the blocks contain a tongue-and-groove or other structure that allows the blocks to interlock and hold together by a mechanical and/or friction fit.

Lifting devices for the placement of blocks in segmental retaining walls and other modular block structures are well known. A lifting device may be attached to a backhoe, crane, or other vehicle or tool to lift heavy blocks and move them into place. Unfortunately, current lifting devices have limited use. Many can only lift one block at a time, and thus are time-consuming to use. Others can only be used with certain styles and types of blocks, which means that workers must purchase and carry multiple lifting devices if they want to work with blocks from more than one supplier.

The disclosure contained below describes a new tool that addresses one or more of the problems described above.

SUMMARY

In an embodiment, a support structure for lifting precast blocks includes a longitudinal support arm having a cable suspended therefrom at several suspension points. Cradles are connected to the cable in positions such that each cradle is positioned between and below a pair of the suspension points. Each cradle may be attached to a sheave so that the cradle is moveably secured to the cable. Each cradle may receive a handle or another portion of a lifting tool below the support arm.

In an alternate embodiment, a precast block lifting support structure includes a longitudinal support arm having a cable suspended therefrom at a plurality of suspension points; a set of sheaves, each sheave movably connected to the cable between a pair of the suspension points; a set of cradles, each cradle secured to one of the sheaves and configured to receive a lifting tool below the support arm; a central support member; and a pair of lateral support arms, each of which extends angularly outward from the central support member at a first end and attaches to an opposing end area of the longitudinal support arm. Lifting tools may be placed in each cradle. The lifting tools may each have a set of pins extending therefrom so that, when a lifting force is applied to the support arm, the pins of each lifting tool move toward each other and hold a precast block by friction.

In an alternate embodiment, a method of lifting precast blocks, includes placing a lifting tool into a precast concrete block. Each tool has a pair of pins, the block has a pair of receptacles, and the placing is performed so that the pair of pins is placed into the pair of receptacles. The placing is repeated for additional lifting tools and blocks. Each lifting tool is secured into a cradle, wherein each cradle is suspended from a longitudinal support arm of a lifting support structure. A vertical lifting machine is used to lift the longitudinal support arm so that the cradles rise, thus raising each lifting tool so that the pins of each lifting tool move and hold the blocks by friction, thus lifting the blocks.

DETAILED DESCRIPTION

This disclosure is not limited to the particular methodologies, systems and materials described, as these may vary. The terminology used in this description is for the purpose of describing the particular versions or embodiments only, and is not intended to limit the scope. In addition, the word "comprising" as used in this document is intended to mean "including but not limited to." Unless defined otherwise, all technical and scientific terms used herein have the same meanings as commonly understood by one of ordinary skill in the art.

Figure 1:
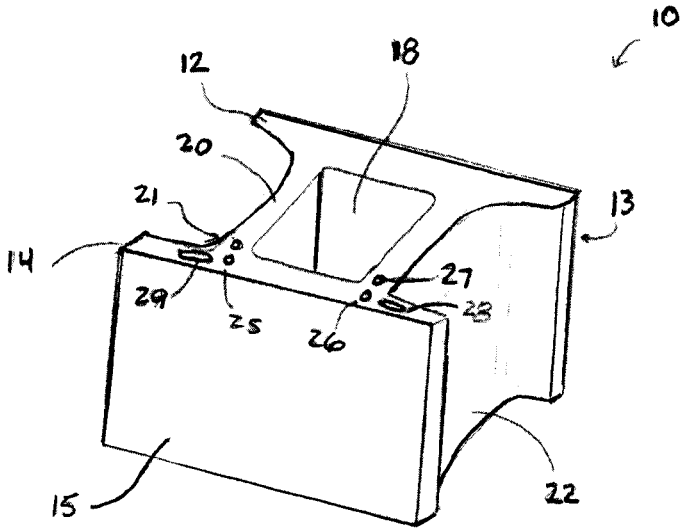
FIG. 1 PRIOR ART
FIG. 1 depicts a pre-cast structural block such as the type that may be found in the prior art.

FIG. 1 illustrates an exemplary pre-cast block, typical of one that may be found in the prior art for use in retaining wall construction. As shown in FIG. 1, block 10 includes a head portion 12 including a rear face 13, a body portion 14 including a front face 15, and a neck portion 20 that connects the head portion 12 and the body portion 14. When stacked in a retaining wall structure, rear face 13 may face toward a hill, soil, or area to be retained. The front face 15 may face outward from the area to be retained and will be visible to passersby.

The neck portion of the block 10 includes an opening 18 that extends vertically though the block. Opening 18 typically has four or more sidewalls arranged in a substantially square or rectangular position, or in positions to form another type of polygon. The opening 20 divides the neck portion into first and second neck wall members 21 and 22 so that each wall member extends between the head portion 12 and body portion 14. The block also may have one or more grooves, protrusions, pins, receptacles, or other structural features that help the block interlock with adjacent blocks. For example, the block may have one or more receptacles 25 or pairs of receptacles 26, 27 that each receive a pin, post, prong, or similar structure. Some of the receptacles may be non-circular, such as the oblong-shaped receptacles 28, 29 shown in FIG. 1. Such receptacles can accept a variety of prongs at a variety of angles. The receptacles 25-29 may extend through all of the block or only into a portion of the block.

Figure 2:
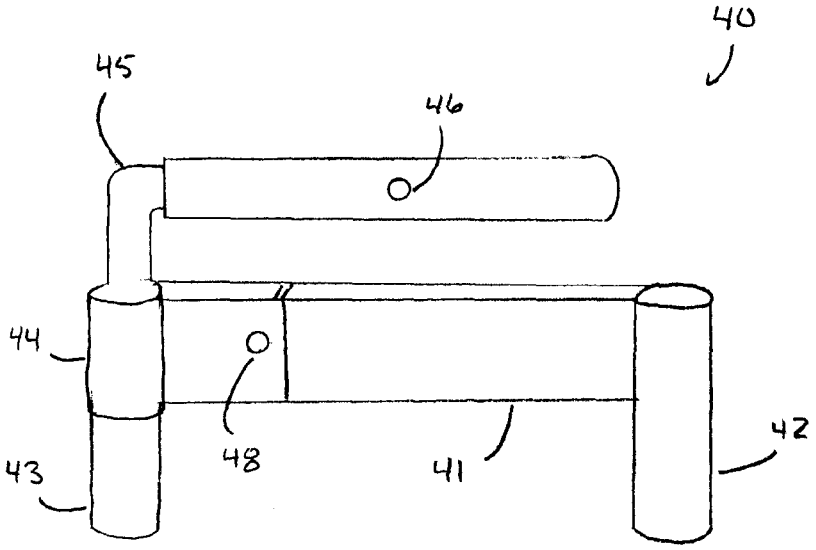
FIG. 2 depicts an exemplary hand lifting tool.

When a block 10 such as that shown in FIG. 1 is lifted and placed into position, a lifting tool may use the opening 18 and/or one or more of the receptacles 25-29 to grasp the block. For example, FIG. 2 illustrates a hand lifting tool 40 having a longitudinal body 41 having a first end and a second end, a first prong 42 attached to and extending from a first end of the body 41, and a second prong 43 extending from a second end of body 41. First and second prongs 42, 43 are configured to be positioned in parallel with each other, to be perpendicular with respect to the body 41, and to fit within two receptacles 28, 29 of a block such as that shown in FIG. 1. Optionally, the prongs may each have an outside diameter of about 1 inch and a length of 3½ inches for a block having receptacles of slightly larger inside diameter and depth, but other sizes are possible so long as the prongs fit into the receptacles of the precast block. Second prong 43 may be interconnected with a handle 45 via a pivoting or non-pivoting sleeve 44. When the prongs 42, 43 of the device are placed into a block and the handle 45 is lifted, the body 41 of the device may pivot about a hinge 48 so that the prongs are not completely parallel to each other and grip the block. The handle 45 may include a receptacle 46 or other structure whose function will be described below.

Figure 3:
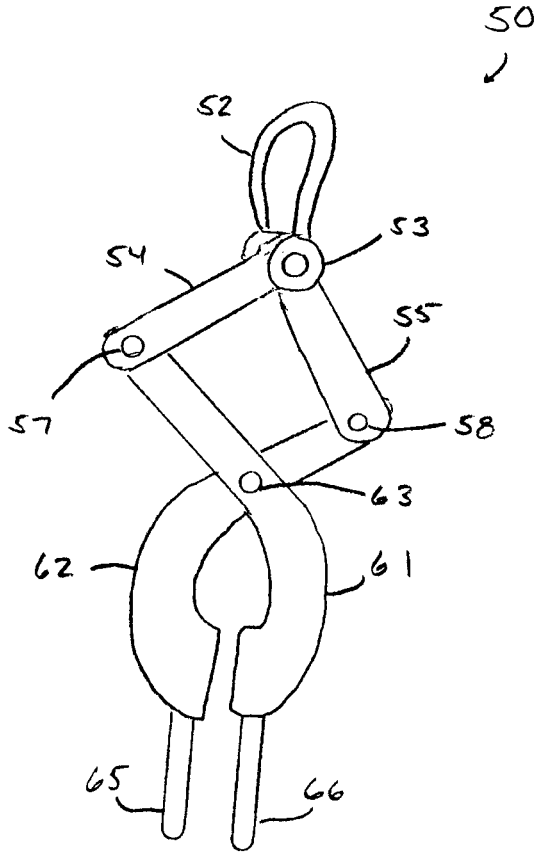
FIG. 3 depicts an alternate hand lifting tool.

FIG. 3 illustrates an alternate lifting device 50 having an upper holder 52 such as a hook, eyelet or sheave. The hook includes an axle 53 or pivot point from which a first pair of arms 54, 55 extends angularly outward and downward from the holder 52. The arms 54, 55 may each have a first end that rotates at the pivot point 53. A second set of arms 61, 62 extends downward from the first set of arms. Each arm in the second set is rotatably connected to an arm in the first set by an axle 57, 58. Each arm in the second set may have a lateral portion and a curved or angled portion. The arms of the second set are rotatably attached to each other at a connection point 63 so that the first set of arms and the lateral portion of each arm in the second set form a diamond. The curved/angled portion of each arm 61, 62 in the second set extends downward from the connection point 63 and accepts or includes a pin 65, 66 that may be inserted into receptacles 28, 29 of a block. When a lifting force is applied to the holder 52, each pivot point will move so that the pins 65, 66 move toward each other and hold the block by friction.

Other hand lifting devices are known. For example, referring to FIG. 2, a hand lifting device may have a handle leading to a head end. The head end may have two adjacent prongs that fit into two adjacent holes 26, 27 of a precast block.

Figure 4:
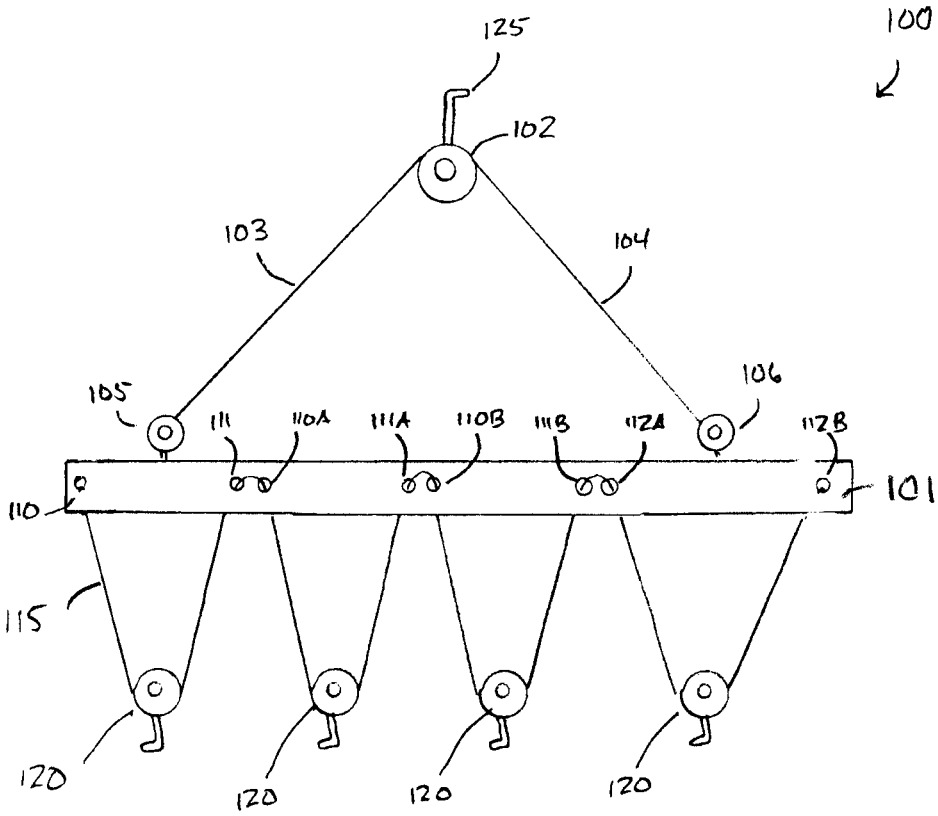
FIG. 4 depicts an exemplary multi-block lifting device.

FIG. 4 illustrates an exemplary lifting tool support structure 100 having elements characteristic of the embodiments described in this document. Lifting tool support structure 100 includes a longitudinal support member 101 made of a rigid material such as steel. The longitudinal support member 101 may be a bar, pipe, column, or any member having a length that exceeds its width or height. The longitudinal support member 101 may be made of steel or another type of strong metal or other secure material. The longitudinal support member 101 is suspended from a central connecting member 102 and lateral support arms 103, 104, which may be cables, bars, or other structures. In an embodiment such as that shown in FIG. 4 for use in connecting four lifting tools, the longitudinal support member 101 is approximately 6½ feet wide, although other sizes are possible. Central connecting member 102 may contain a hook, eye, clamp, pulley, sheave, or other structure 125 that allows the central connecting member 102 to be connected to a backhoe, crane, winch, or other item of moveable field construction equipment.

Support arms 103, 104 may be cables, portions of a single cable, chains, rigid or flexible bars, or other structures. The support arms 103, 104 may be made of metal or other material. Support arms 103, 104 extend angularly from the central connecting member and connect to the longitudinal support member 101 via hooks, eyelets, pulleys, sheaves, or other connection points 105, 106. Connection points 105, 106 are positioned so that each is positioned to be located approximately the same distance from opposing ends of the longitudinal support member 101. Such an arrangement will permit the device 100 to balance a load. Each connection point 105, 106 is also positioned so that it is closer to an end of the longitudinal support member 101 than it is to the midpoint of the longitudinal support member 101.

Longitudinal support member 101 includes a plurality of suspension points 110, 111 such as holes through which a load supporting cable 115 or cables may be threaded and/or connected. Alternatively, instead of holes, the support member may include pulleys, sheaves, or equivalent structures to serve as pivot points around which the cable 115 may be threaded. The pivot points may be positioned so that they are spaced a distance apart from each other that is equal to or slightly greater than the size of the widest face of the blocks to be lifted, although other positions and sizes are possible. When holes are used as the suspension points, the holes are spaced apart laterally along the member in pairs so that the holes in each pair (see, e.g. 110, 111) are spaced further apart from each other than one hole in the pair is from the next hole in the next adjacent pair (see, e.g., holes 111 and 110A in FIG. 4). Each hole or sheave in a pair serves as a suspension point for a portion of the cable 115 that is suspended from that pair. The total number of pivot points will be one more than the number of lifting tools that may be connected to the support structure. Optionally, additional holes or other suspension points may be provided so that the cable 115 may be rethreaded through a differently spaced set of holes to accommodate differently-sized blocks.

Figure 5:
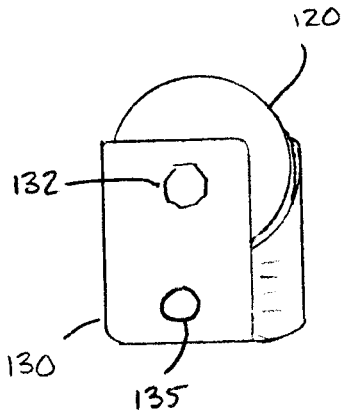
FIG. 5 illustrates an exemplary sheave and cradle for a multi-block lifting device.

The cable 115 may be threaded through the holes or around the upper sheaves or otherwise suspended from the suspension points 110, 111 so that a sheave 120 or equivalent structure is suspended below and between each pair of upper sheaves or hole sets via the cable. As shown in FIG. 5, each sheave 120 may include a suspended cradle 130 that accepts an arm of a lifting tool. FIG. 5 shows an exemplary cradle made of a ⅛-inch steel plate that is bent into a U-shape connected to the sheave's axle or bolt 132, although other cradle structures and sizes are possible. Optionally, one or both sides of the cradle may include a receptacle 135 so that, when a handle of a lifting device is inserted in the cradle, the tool's receptacle will line up with the cradle's receptacle and a pin, bolt or other structure may be placed through the receptacles to secure the handle of the tool to the cradle. As shown in FIG. 4, each sheave 120 may be movable along the cable so that it can be adjusted into position.

Figure 6:
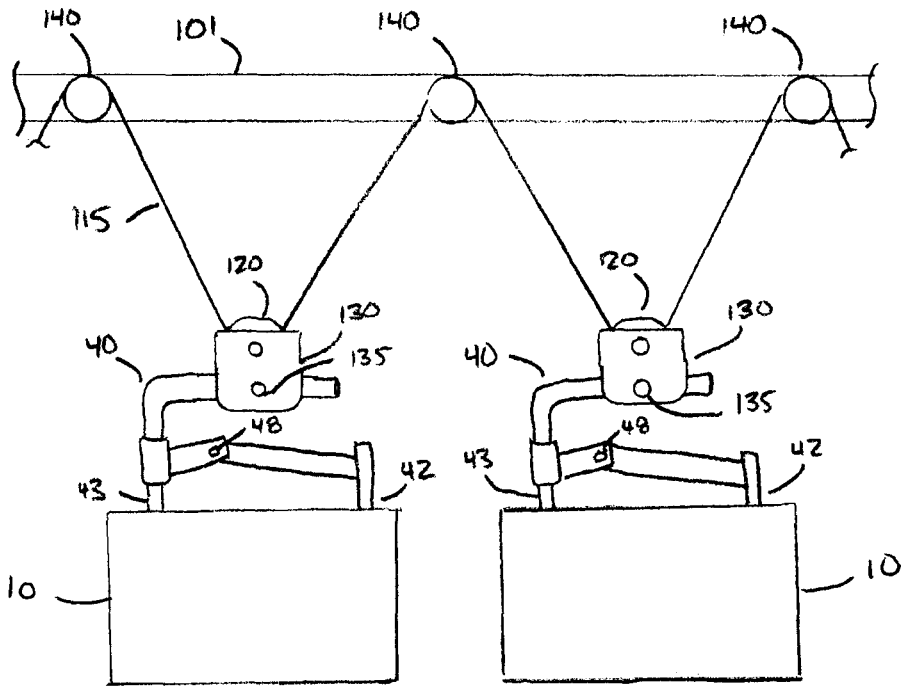
FIG. 6 illustrates an exemplary application of a multi-block lifting device.

FIG. 6 illustrates an exemplary application of a multi-block lifting device. A longitudinal support member 101 includes a plurality of upper pivot points 140, in this example sheaves. A cable 115 is suspended from the upper pivot points 140, so that a lower sheave 120 is suspended below and between each two upper sheaves 140. Each lower sheave has a connected cradle 130. A handle of a lifting tool 40 such as that shown in FIG. 2 is positioned through each cradle 130 so that the lifting tools can be inserted into a block 10 via prongs 42, 43. As shown in FIG. 6, when the longitudinal bar 101 is lifted the lifting tool 40 will bend at its pivot point 48 and the prongs 42, 43 of each lifting tool 40 will secure its corresponding block 10 by friction. In this embodiment, one may substitute the tools of FIG. 3 so that their holders 52 are secured in the cradles 130 and achieve the same result.

It will be recognized from the above disclosure that additional types of hand lifting tools may be used with the multi-block lifting device. For example, lifting tools have single handles and two-pronged ends may be placed in the cradles so that two tools are positioned in opposing directions in each cradle. Other configurations are possible.

A method of using the device described above may include placing a lifting tool into a precast concrete block. The tool has a pair of movable pins, the block has a pair of receptacles, and the placing is performed so that the pair of pins is placed into the pair of receptacles. This process is repeated for two or more additional lifting tools and blocks. Each lifting tool is secured into a cradle that is suspended from a longitudinal support arm of a lifting support structure. A vertical lifting machine such as a winch, crane or other lift is used to lift the longitudinal support arm so that the pins of each lifting tool move and hold the blocks by friction, thus lifting the blocks.

While several embodiments of the invention have been described herein by way of example, those skilled in the art will appreciate that various modifications, alterations, and adaptations to the described embodiments may be realized without departing from the spirit and scope of the invention defined by the appended claims and accompanying disclosure.

What is claimed is:

1. A precast block lifting support structure, comprising:

a longitudinal support arm having a cable suspended therefrom at a plurality of suspension points;

a plurality of cradles suspended from the cable, each cradle positioned between a pair of the suspension points and configured to receive a lifting tool below the support arm; and a plurality of lifting tools, wherein each lifting tool is suspended from one of the cradles and comprises:

a longitudinal body having a first end and a second end;

first and second prongs positioned at the first and second end of the longitudinal body, each prong extending from the body in a direction that is perpendicular to the body;

a handle extending from the body and containing a securing structure configured to secure the handle to the cradle; and a hinge positioned on the longitudinal body between the first and second prongs.

2. The structure of claim 1, further comprising a plurality of sheaves, each sheave connected to the cable between a pair of the suspension points so that each of the sheaves movably connects a corresponding one of the cradles to the cable.

3. The structure of claim 2, further comprising:

a central support member;

a pair of lateral support arms, each of which extends angularly outward from the central support member at a first end and attaches to an opposing end area of the longitudinal support arm.

4. The structure of claim 3, wherein the central support member comprises a hook, eye, pulley or sheave.

5. The structure of claim 3, wherein each end area comprises a connection point, each connection point is an equal distance from its closest end of the support member, and each connection point is closer to its closest end of the support member than it is to the midpoint of the longitudinal support member.

6. The structure of claim 1, wherein each suspension point comprises a hole so that the cable is threaded through each hole and a single cable may be suspended from the arm.

7. The structure of claim 1, wherein each suspension point comprises a sheave so that the cable passes around each sheave and a single cable may be suspended from the arm.

8. The structure of claim 1, wherein the plurality of lifting tools, are configured so that, when a lifting force is applied to the support arm, the prongs of each lifting tool move toward each other and hold a precast block by friction.

9. The structure of claim 1, wherein the support arm comprises a plurality of additional suspension points so that the cable may be repositioned to suspend from at least some of the additional suspension points.

10. A precast block lifting support structure, comprising:

a longitudinal support arm having a cable suspended therefrom at a plurality of suspension points;

a plurality of sheaves, each sheave movably connected to the cable between a pair of the suspension points a plurality of cradles, each cradle secured to one of the sheaves and configured to receive a lifting tool below the support arm;

a central support member;

a pair of lateral support arms, each of which extends angularly outward from the central support member at a first end and attaches to an opposing end area of the longitudinal support arm; and a plurality of lifting tools, wherein each lifting tool is suspended from one of the cradles and comprises:

a longitudinal body having a first end and a second end, first and second prongs positioned at the first and second end of the longitudinal body, each prong extending from the body in a direction that is perpendicular to the body, a handle extending from the body and containing a receptacle configured to match with a hole in the cradle so that when the handle is in the cradle, the handle may be secured to the cradle by a member placed into the handle receptacle and the cradle hole, and a hinge positioned on the longitudinal body between the first and second prongs.

11. The structure of claim 10, wherein the plurality of lifting tools, are configured so that, when a lifting force is applied to the support arm, the prongs of each lifting tool move toward each other and hold a precast block by friction.

12. The structure of claim 10, wherein the support arm comprises a plurality of additional suspension points so that the cable may be repositioned to suspend from at least some of the additional suspension points.

13. A method of lifting a plurality of precast blocks, the method comprising:

placing a lifting tool into a precast concrete block, wherein:

the tool comprises:

a longitudinal body having a first end and a second end, a pair of pins, each of the pins extending from the body in a direction that is perpendicular to the body, and a handle extending from the body and containing a securing structure; and a hinge positioned on the longitudinal body between the pair of pins, and the block has a pair of receptacles, and the placing is performed so that the pair of pins is placed into the pair of receptacles;

repeating the placing for a plurality of additional lifting tools and blocks securing each lifting tool into a cradle, wherein each cradle is suspended from a longitudinal support arm of a lifting support structure; and lifting, using a vertical lifting machine, the longitudinal support arm so that the cradles rise, thus raising each lifting tool so that the pins of each lifting tool move and hold the blocks by friction, thus lifting the blocks.

* * * * *